US007800572B2

(12) United States Patent
Kumeta et al.

(10) Patent No.: US 7,800,572 B2
(45) Date of Patent: Sep. 21, 2010

(54) LIQUID CRYSTAL DISPLAY FOR IMPLMENTING IMPROVED INVERSION DRIVING TECHNIQUE

(75) Inventors: Masayuki Kumeta, Kanagawa (JP); Kouji Matsuura, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 987 days.

(21) Appl. No.: 11/256,017

(22) Filed: Oct. 24, 2005

(65) Prior Publication Data

US 2006/0087484 A1 Apr. 27, 2006

(30) Foreign Application Priority Data

Oct. 25, 2004 (JP) ..... 2004-310128

(51) Int. Cl.
*G09G 3/36* (2006.01)

(52) U.S. Cl. ..... 345/96; 345/54; 345/79; 345/209

(58) Field of Classification Search ..... 345/96, 345/87, 54, 79, 209, 88, 89, 100
See application file for complete search history.

(56) References Cited

U.S. PATENT DOCUMENTS 5,764,207 A * 6/1998 Maekawa et al. ..... 345/99
5,973,660 A 10/1999 Hashimoto
6,014,122 A * 1/2000 Hashimoto ..... 345/98
6,069,605 A * 5/2000 Ozawa ..... 345/98
6,424,328 B1 * 7/2002 Ino et al. ..... 345/87
6,661,402 B1 * 12/2003 Nitta et al. ..... 345/99
6,778,158 B2 * 8/2004 Sun ..... 345/87
6,853,362 B2 * 2/2005 Bu ..... 345/96
7,068,292 B2 * 6/2006 Morita ..... 345/690

FOREIGN PATENT DOCUMENTS

CN 1311502 A 9/2001
JP 10-62744 3/1998

OTHER PUBLICATIONS

Chinese Office Action dated Jan. 25, 2008, with English language translation.

* cited by examiner

*Primary Examiner*—Amare Mengistu
*Assistant Examiner*—Koosha Sharifi
(74) *Attorney, Agent, or Firm*—McGinn IP Law Group, PLLC

(57) ABSTRACT

A liquid crystal display apparatus is composed of an LCD panel including data lines, and an LCD driver. The LCD driver includes: a positive drive circuit providing a positive data signal having positive polarity with respect to a ground level of the LCD driver for one of the data lines; and a negative drive circuit providing a negative data signal having negative polarity with respect to the ground level of the LCD driver for another one of the data lines.

23 Claims, 13 Drawing Sheets

LIQUID CRYSTAL DISPLAY FOR IMPLMENTING IMPROVED INVERSION DRIVING TECHNIQUE

BACKGROUND OF THE INVENTION

1. Field of the Invention

The present invention relates to apparatuses and methods for driving display devices, especially to improvement in the inversion driving technique.

2. Description of the Related Art

Liquid crystal displays often suffer from the "burn-in" effect, which is known as a phenomenon in which applying a DC voltage to pixels within a liquid crystal display causes serious degradation of the lifetime of liquid crystal material filled in the pixels.

In order to avoid the "burn-in" effect, liquid crystal displays often adopt an inversion driving technique (or an alternating driving technique). The inversion driving technique involves periodically inverting the polarity of the data signal applied to each pixel. The inversion driving technique effectively reduces the DC component of the voltage across the liquid crystal capacitance within the pixel, and thereby avoids the "burn in" effect.

The inversion driving technique is schematically classified into common constant driving and common inverting driving. The common constant driving designates a driving method which inverts the polarities of data signals applied to the pixels, with the potential of the common electrode (or the back electrode) kept constant; the potential of the common electrode is referred to as the common potential $V_{COM}$, hereinafter. The common inversion driving, on the other hand, designates a driving method which inverts both of the polarities of data signals and the potential of the common electrode.

The common constant driving is advantageous in terms of the stability of the common potential $V_{COM}$ over the common inversion driving. As known in the art, the stability of the common potential $V_{COM}$ is important for reducing flicker. Therefore, the present invention is directed to the common constant driving.

One issue of conventional common constant driving techniques is that drive circuits developing data signals are required to operate on a high power source voltage. A typical liquid crystal driver adopting the common constant driving requires feeding drive circuits with a power supply voltage equal to or higher than twice of maximum voltages applied to pixels. For the case that the liquid crystal capacitances are supplied with a voltage of 5 V at a maximum, the drive circuits require a power supply voltage of 10 V.

Operating drive circuits on a high power supply voltage is accompanied by two disadvantages: Firstly, circuit elements within the drive circuits are required to have a high withstand voltage, specifically, equal to or higher than twice of the maximum voltages applied to the pixels. Another disadvantage is the increase in the power consumption. The power consumption of the drive circuits proportionally increases as the power supply voltage, and therefore, the increase in the power supply voltage undesirably increases the power consumption.

Japanese Laid-Open Patent Application (JP-A-Heisei, 10-62744) discloses LCD driver architecture for overcoming these disadvantages. FIG. 1 is a block diagram illustrating the conventional LCD driver architecture. The conventional LCD driver deals with the above-described problem through separating the circuitry for developing data signals of the positive polarity with respect to the common potential $V_{COM}$ from the circuitry for developing data signals of the negative polarity with respect to the common potential $V_{COM}$ and from each other.

More specifically, the LCD drive shown in FIG. 1 is composed of an input-side polarity switch circuitry 101, a grayscale voltage generator circuit 102, a set of positive-side driver circuitries 103, a set of negative-side driver circuitries 104, an output-side polarity switch circuitry 105, a polarity switch control circuit 106, and a timing controller circuit 107.

The input-side polarity switch circuitry 101 forwards pixel data associated with respective pixels within the LCD panel to desired ones of the positive-side driver circuitries 103 and the negative-side driver circuitries 104 in response to the polarities of data signals supplied to the respective pixels.

The grayscale voltage generator circuit 102 is composed of a positive grayscale voltage generator 102*a*, and a negative grayscale voltage generator 102*b*. The positive grayscale voltage generator 102*a* develops a set of grayscale voltages of the positive polarity with respect to the common potential $V_{COM}$, and the negative grayscale voltage generator 102*b* develops a set of grayscale voltages of the negative polarity with respect to the common potential $V_{COM}$.

The positive-side driver circuitries 103 develop data signals of the positive polarity with respect with the common potential $V_{COM}$ 103, using the grayscale voltages received from the positive grayscale voltage generator 102*a*. When the common potential $V_{COM}$ is 5 V and the maximum voltages applied to the pixels is 5V, for example, the positive-side driver circuitries 103 develop data signals having signal levels of 5 to 10 V. The positive-side driver circuitries 103 are each composed of a latch circuit 103*a*, a level shifter 103*b*, a D/A converter 103*c*, and a positive drive circuit 103*d*. In order to develop data signals having signal levels of 5 to 10 V, the positive drive circuits 103d are fed with a power supply voltage of 10 V. The positive drive circuits 103*d* are each typically composed of an operation amplifier.

Correspondingly, the negative-side driver circuitries 104 develop data signals of the negative polarity with respect with the common potential $V_{COM}$ 103, using the grayscale voltages received from the negative grayscale voltage generator 102*b*. When the common potential $V_{COM}$ is 5 V and the maximum voltages applied to the pixels is 5V, for example, the negative-side driver circuitries 103 develop data signals having signal levels of 0 to 5 V. The negative-side driver circuitries 104 are each composed of a latch circuit 104*a*, a level shifter 104*b*, a D/A converter 104*c*, and a negative drive circuit 104*d*. In order to develop data signals having signal levels of 0 to 5 V, the negative drive circuits 104*d* are fed with a power supply voltage of 5 V. The negative drive circuits 104*d* are each typically composed of an operation amplifier.

The output-side polarity switch circuitry 105 forwards the data signals developed by the positive-side driver circuitries 103 and the negative-side driver circuitries 104 to desired ones of the output terminals 108. The output terminals 108 are connected with data lines within an LCD panel, and the data signals are fed to the data lines through the output terminals 108.

The output-side polarity switch 105 is provided with switches 105*a* for precharging the output terminals 108 to half of the LCD drive voltage $V_{LCD}$, that is, the potential of 5 V.

The feature of the LCD driver shown in FIG. 1 is that the LCD driver is composed of the positive-side driver circuitries 103, dedicated for developing the positive data signals, and the negative-side driver circuitries 104, dedicated for developing the negative data signals. This architecture only requires providing the negative-side driver circuitries 104 with a power supply voltage comparable to the maximum voltage across the pixels; the negative-side driver circuitries 104 do not require to be fed with a power supply voltage of twice or more of the maximum voltage across the pixels. This effectively reduces the power consumption of the LCD driver.

Another advantage is that the circuit elements within the positive drive circuits 103*d* and the negative drive circuits 104*d* are applied with voltages comparable to the maximum voltage across the pixels at a maximum. This is because the output terminals 108 are precharged to the half level of the liquid crystal drive voltage $V_{LCD}$ by the switches 105*a*. The LCD drive architecture shown in FIG. 1 eliminates the need for designing the positive drive circuits 103*d* and the negative driver circuits 104*d* to have a high withstand voltage.

From the inventors' study, however, there is room for further reducing the power consumption for the LCD driver shown in FIG. 1. Although the above-described LCD driver lowers the power supply voltage supplied to the negative drive circuits 104, the negative drive circuits 104 still requires to operate a high power supply voltage.

FIG. 2 is a diagram illustrating the drawback of the conventional LCD driver shown in FIG. 1. FIG. 2 shows an example assuming that the general power source of the LCD driver develops a power supply voltage of 3 V, the common potential $V_{COM}$ is 5 V, and the maximum voltage across the pixels is also 5 V. In this case, the negative drive circuits 104*d* are designed to output data signals having signal levels of 0 to 5 V. This requires feeding a power supply voltage of 5 V to the negative drive circuits 104*d*. This requirement is easily satisfied by doubling the power supply voltage developed by the general power source, and stepping down the doubled power supply voltage to develop a power supply voltage of 5 V.

The positive driver circuits 103d, on the other hand, are designed to output data signals having signal levels of 5 to 10 V. This requires quadrupling the power supply voltage developed by the general power source, and stepping down the quadrupled power supply voltage to develop a power supply voltage of 10 V.

Although reducing the power supply voltage fed to the negative drive circuits 104*d* down to 5 V, the architecture shown in FIG. 5 requires feeding the power supply voltage as high as 10 V. This is undesirable for reducing the power consumption.

SUMMARY OF THE INVENTION

In an aspect of the present invention, a liquid crystal display apparatus is composed of an LCD panel including data lines; and an LCD driver. The LCD driver includes: a positive drive circuit providing a positive data signal having positive polarity with respect to a ground level of the LCD driver for one of the data lines; and a negative drive circuit providing a negative data signal having negative polarity with respect to the ground level of the LCD driver for another one of the data lines.

The architecture of the liquid crystal display apparatus according to the present invention effectively reduces the difference between the maximum signal level of the positive data signals and the ground level of the LCD driver, and also reduces the difference between the ground level of the LCD driver and the minimum signal level of the negative data signals, approximately down to the maximum voltages applied across the pixels, not twice of the maximum voltages. In other words, this architecture effectively reduces the power source voltages of both of the positive and negative drive circuits approximately down to the maximum voltages applied across the pixels. This effectively reduces the power consumption of the LCD driver.

Preferably, the liquid crystal display apparatus additionally includes a precharge circuitry for precharging the data lines within the LCD panel to the ground level of said LCD driver. Such architecture effectively reduces the voltage applied to the positive and negative drive circuits, and also reduces the power consumption necessary for precharging the data lines.

BRIEF DESCRIPTION OF THE DRAWINGS

The above and other advantages and features of the present invention will be more apparent from the following description taken in conjunction with the accompanied drawings, in which.

DESCRIPTION OF THE PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

First Embodiment (Structure of LCD Apparatus)

Figure 3:
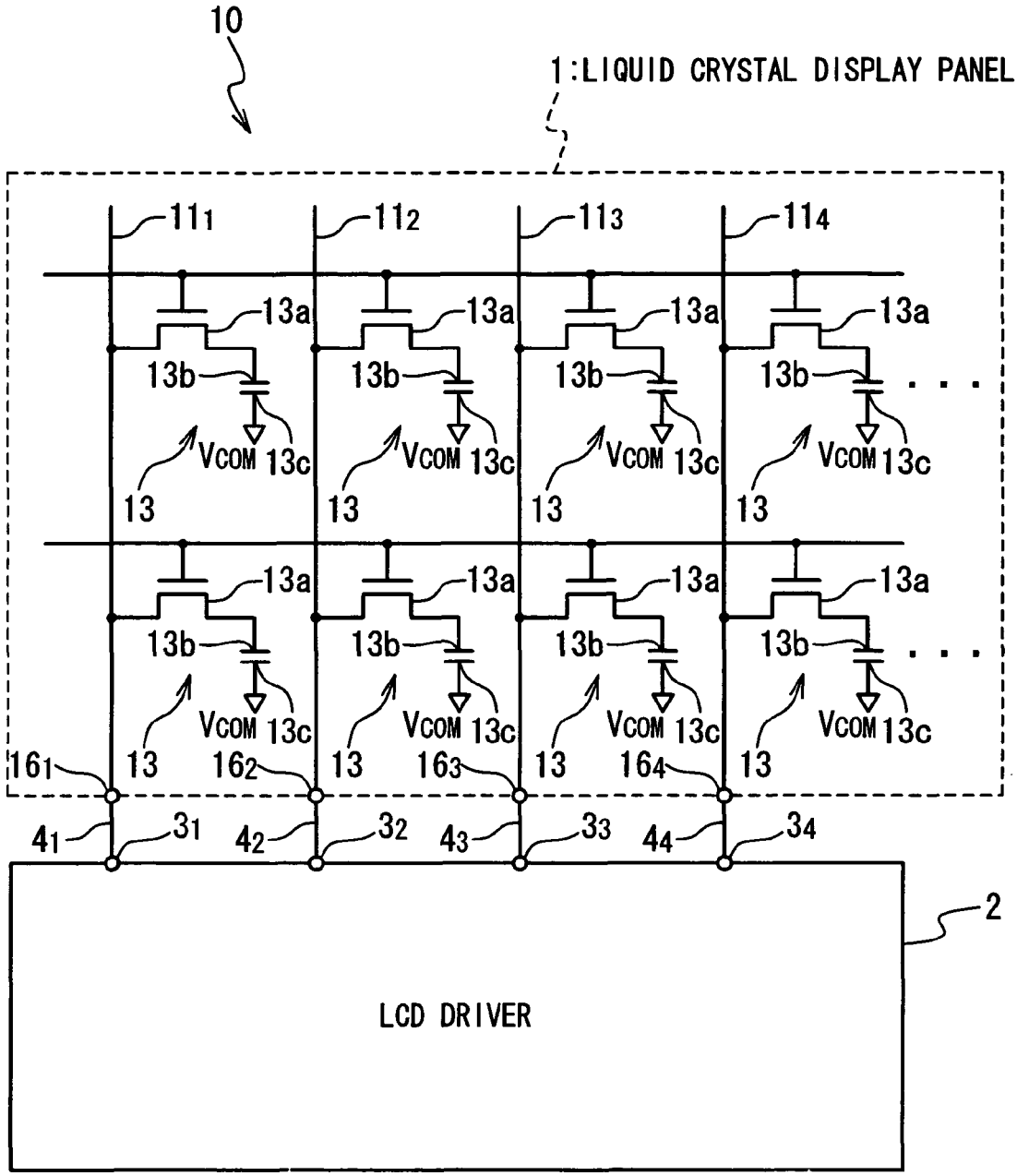
FIG. 3 is a block diagram illustrating an exemplary structure of an LCD apparatus in a first embodiment of the present invention.

FIG. 3 is a diagram illustrating an exemplary structure of an LCD apparatus 10 in a first embodiment of the present invention. The LCD apparatus 10 is composed of an LCD panel 1, and an LCD driver 2. The LCD panel 1 is composed of data lines 11, gate lines 12, and pixels 13 arranged at respective intersections of the data lines 11 and the gate lines 12. The data lines 11 are connected with input terminals 16, and receive data signals from the LCD driver 2 through the input terminals 16. The gate lines 12 are used for selecting rows (or lines) of the pixels 13. When the pixels 13 on a selected line are driven with data signals, one of the gate lines 12 associated with the selected line is activated. The pixels 13 are each composed of a TFT (thin film transistor) 13*a*, and a pixel electrode 13*b* opposed to a common electrode 13*c*. Liquid crystal material is filled between the pixel electrodes 13*b* and the common electrode 13*c*, and the pixel electrodes 13*b* and the common electrode 13*c* function as capacitors. The common electrode 13*c* is maintained at a certain potential, referred to as the common potential $V_{COM}$.

The LCD driver 2 is an integrated circuit for driving the pixels 13 within the LCD panel 1. The LCD driver 2 has a set of output terminals 4 connected with the input terminals 16 of the LCD panel 1 through a set of signal lines 4. The data signals are fed from the output terminals 3 of the LCD driver 2 to the associated data lines 11 through the signal lines 4 and the input terminals 16, and thereby the pixels 13 on the selected line are driven.

One feature of the present invention is that the LCD driver 2 is designed to develop a set of data signals having the positive polarity with respect to the ground level of the LCD driver 2, and a set of data signals having the negative polarity with respect to the ground level of the LCD driver 2. Such design effectively reduces the power supply voltages fed to drive circuits developing the data signals having the positive polarity as well as drive circuits developing the data signals having the negative polarity, and thereby reduces the power consumption of the LCD driver 2. The data signals having the positive polarity with respect to the ground level of the LCD driver 2 may be referred to as the "positive data signals", and the data signals having the negative polarity with respect to the ground level of the LCD driver 2 may be referred to as the "negative data signals".

(LCD Driver Structure)

Figure 4:
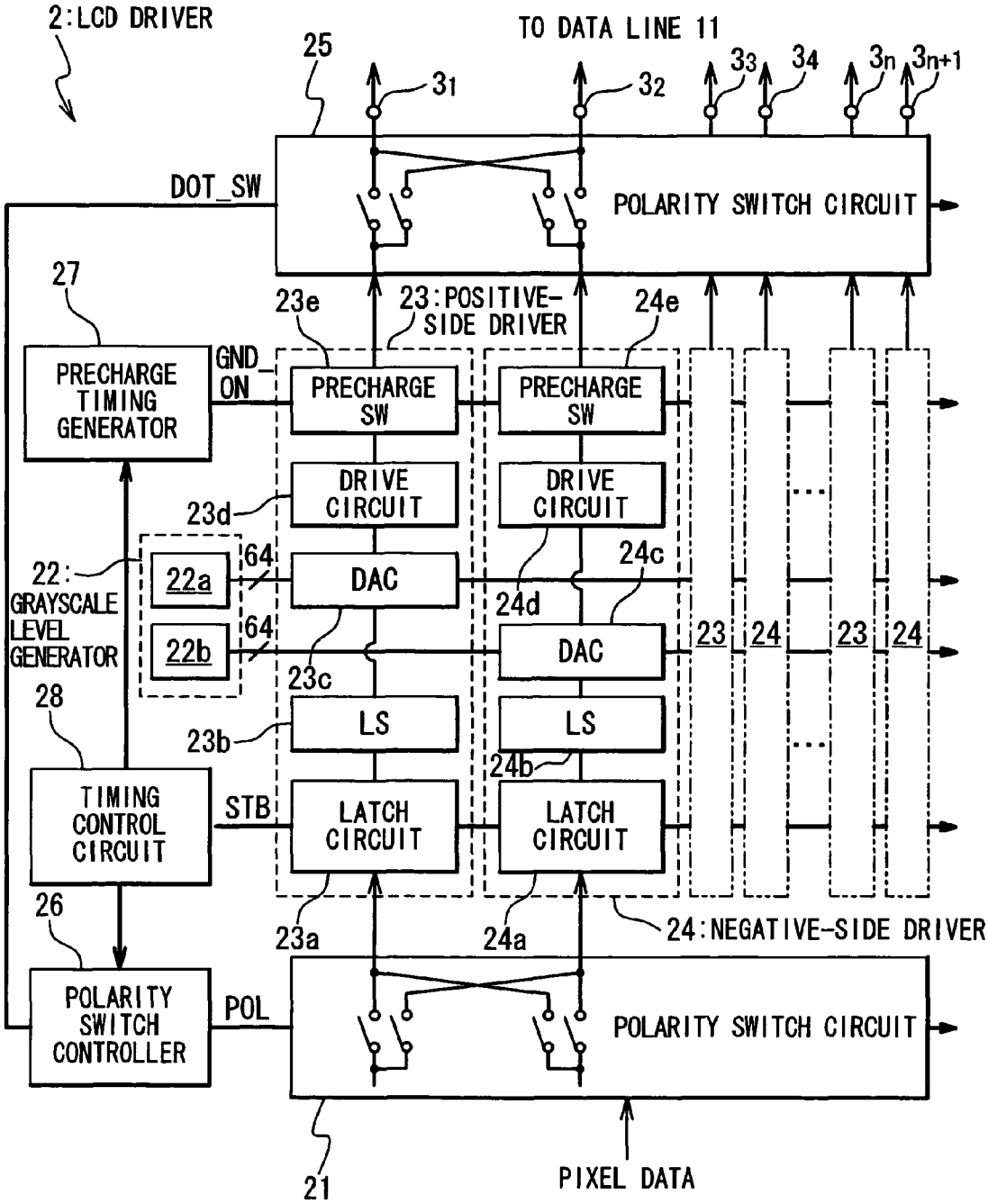
FIG. 4 is a block diagram illustrating an exemplary structure of an LCD driver in the first embodiment.

FIG. 4 specifically illustrates an exemplary structure of the LCD driver 2. The LCD driver 2 is composed of an input-side polarity switch circuitry 21, a grayscale voltage generator circuit 22, a set of positive-side driver circuitries 23, a set of negative-side driver circuitries 24, an output-side polarity switch circuitry 25, a polarity switch control circuit 26, a precharge switch timing generator 27, and a timing control circuit 28.

The input-side polarity switch circuitry 21 forwards pixel data associated with the respective pixels 13 to desired ones of the positive-side driver circuitries 23 and the negative-side driver circuitries 24. The input-side polarity switch circuitry 21 receives pixel data indicative of grayscale levels of the pixels 13 associated with the selected line, and forwards the pixel data associated with the pixels to be driven with positive data signals to the positive-side driver circuitries 23, while forwarding the pixel data associated with the pixels to be driven with negative data signals to the negative-side driver circuitries 24.

The grayscale voltage generator circuit 22 provides a set of grayscale voltages, which are respectively associated with allowed grayscale levels of the pixels 13. The grayscale voltage generator circuit 22 is composed of a positive grayscale voltage generator 22*a*, and a negative grayscale voltage generator 22*b*. The positive grayscale voltage generator 22*a* develops a set of grayscale voltages having the positive polarity with respect to the ground level of the LCD driver 2. The negative grayscale voltage generator 22*b*, on the other hand, develops a set of grayscale voltages having the negative polarity with respect to the ground level of the LCD driver 2. The number of the grayscale voltages developed by each of the positive and negative grayscale voltage generators 22*a* and 23*b* is identical to the number of allowed grayscale levels of the pixels 13. When the number of allowed grayscale levels of the pixels 13 is 64, for example, the positive grayscale voltage generator 22*a* provides a set of different grayscale voltage having the positive polarity for the positive-side driver circuitries 23, and the negative grayscale voltage generator 22*b* provides a set of different grayscale voltage having the negative polarity for the negative-side driver circuitries 24.

The positive-side driver circuitries 23 develop positive data signals in response to the pixel data provided thereto. The positive-side driver circuitries 23 use the positive grayscale voltages received from the positive grayscale voltage generator 22*a* to develop the positive data signals.

More specifically, the positive-side driver circuitries 23 are each composed of a latch circuit 23*a*, a level shifter 23*b*, a D/A converter 23*c*, a drive circuit 23*d*, and a precharge switch circuit 23*e*. The latch circuits 23*a* latch the pixel data received from the input-side polarity switch circuitry 21, and forward the latched pixel data to the level shifters 23*b*. The level shifters 23*b* provide level shifting between the latch circuits 23*a* and the D/A converters 23*c*.

The D/A converters 23*c* perform D/A conversion on the pixel data received from the latch circuits 23*a* through the level shifters 23*b* to develop the grayscale voltages associated with the respective pixel data. In detail, the D/A converters 23*c* selects desired ones of the positive grayscale voltages received from the positive grayscale voltage generator 22*a* in response to the pixel data received from the level shifters 23*b*. The selected positive grayscale voltages are provided for the positive drive circuits 23*d*.

The positive drive circuits 23*d* develops positive data signals having signal levels equal to the grayscale voltages received from the D/A converters 23*c*. The developed data signals are outputted through the output terminals 3 of the LCD driver 2. In one embodiment, the positive drive circuits 23*d* are each composed of an operation amplifier.

The precharge circuit 23*e* is designed to precharge the data lines 11 within the LCD panel 1 to the ground level of the LCD driver 2. The precharge circuit 23*e* is responsive to the activation of the precharge signal GND_SW received from the precharge switch timing generator 27 for precharging the data lines 11 to the ground level of the LCD driver 2. Precharging the data lines 11 to the ground level of the LCD driver 2 is important for avoiding the positive drive circuits 23d being subjected to high voltage due to the potential difference between the maximum signal level of the positive data signals and the minimum signal level of the negative data signals.

Correspondingly, the negative-side driver circuitries 24 develop negative data signals in response to the pixel data provided thereto. The negative-side driver circuitries 24 use the negative grayscale voltages received from the positive grayscale voltage generator 22*b* to develop the negative data signals. The structure of the negative-side driver circuitries 24 is almost identical to that of the positive driver circuitries 23; the negative-side driver circuitries 24 are each composed of a latch circuit 24*a*, a level shifter 24*b*, a D/A converter 24*c*, a negative drive circuit 24, and a precharge switch circuit 24*e*. The main difference is that the D/A converters 24*c* receive the negative grayscale voltages from the negative grayscale voltage generator 22*b*, and that the negative drive circuits 24*d* develops negative data signals.

The output-side polarity switch circuitry 25 connects the outputs of the positive-side driver circuitries 23 and the negative-side driver circuitries 24 with desired one of the data lines 11. When the data line 11 is required to output a positive data signal, for example, the data line $\mathbf{11}_1$ is connected with the output of the associated one of the positive-side driver circuitries 23.

The polarity switch control circuit 26 indicates the connections within the polarity switch circuitries 21 and 25; the polarity switch control circuit 26 switches the connections within the input-side polarity switch circuitry 21 by providing a polarity signal POL to the input-side polarity switch circuitry 21, so that the pixel data are transferred to desired ones of the positive-side and negative side driver circuitries 23 and 24. Additionally, the polarity switch control circuit 26 switches the connections within the output-side polarity switch circuitry 25 by providing a switch control signal DOT_SW to the output-side polarity switch circuitry 25, so that the data signals are transferred to desired ones of the data lines 11.

The precharge switch timing generator 27 develops the precharge signal GND_ON used for controlling the precharge switch circuits 23*e* and 24*e*.

The timing control circuit 28 controls operation timings of the input-side polarity switch circuitry 21, the positive-side driver circuitries 23, the negative-side driver circuitries 24, and the output-side polarity switch circuitry 25. Specifically, the timing control circuit 28 generates a latch signal STB to control timings when the latch circuits 23*a* and 24*a* latches the pixel data. Additionally, the timing control circuit 28 controls the polarity switch circuit 26 and the precharge switch timing generator 27 to adjust the timings when the polarity signal POL, the switch control signal DOT_SW, and the precharge signal GND_ON are switched.

(Detail of Output Stage of LCD Driver)

Figure 5:
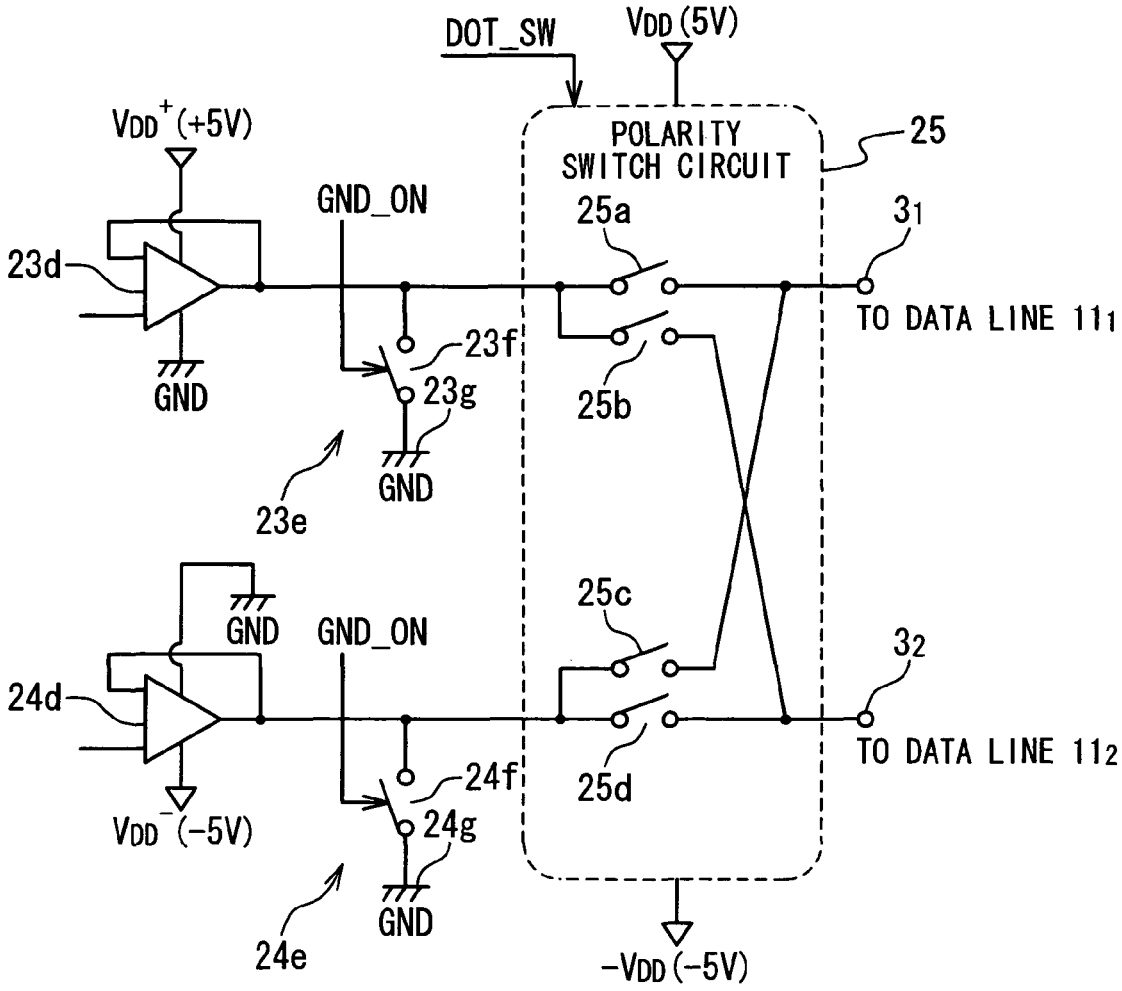
FIG. 5 is a detailed diagram illustrating an output stage of the LCD driver for outputting the data signals.

FIG. 5 is a circuit diagram illustrating details of the positive drive circuit 23*d* and the precharge switch circuit 23*e* within the positive-side driver circuitries 23, and the negative drive circuit 24*d* and the precharge switch circuit 24*e* within the negative-side driver circuitries 24. FIG. 5 selectively illustrates the output stage of the LCD driver 2 associated with the output terminal $\mathbf{3}_1$ and $\mathbf{3}_2$; however, those skilled in the art would appreciate that the remainders are correspondingly designed.

The positive drive circuits 23*d* operate on a positive power source voltage $V_{DD}^+$ to develop the positive data signals. The negative drive circuits 24*d*, on the other hand, operate on a negative power source voltage $V_{DD}^-$ to develop the negative data signals. In one embodiment, the positive power source voltage $V_{DD}^+$ is +5 V, and the negative power source voltage $V_{DD}^-$ is −5 V.

The output-side polarity switch circuitry 25 includes switches 25*a* to 25*d*. The switch 25*a* is connected between the output terminal $\mathbf{3}_1$ and the output of the associated positive drive circuit 23*d*, and the switch 25*b* is connected between the output terminal $\mathbf{3}_2$ and the associated negative drive circuit 24*d*. On the other hand, the switch 25*c* is connected between the output terminal $\mathbf{3}_1$ and the output of the associated negative drive circuit 24*d*, and the switch 25*d* is connected between the output terminal $\mathbf{3}_2$ and the associated positive drive circuit 23*d*.

The switches 25*a* to 25*d* are responsive to the switch control signal DOT_SW to switch connections among the output terminals $\mathbf{3}_1$ and $\mathbf{3}_2$ and the outputs of the associated positive and negative drive circuits 23*d* and 24*d*. Specifically, when the switch control signal DOT_SW is activated, the output terminals $\mathbf{3}_1$ is connected with the associated positive drive circuit 23*d*, and the output terminals $\mathbf{3}_2$ is electrically connected with the associated negative drive circuit 24*d*. Such connections achieve providing positive and negative data signals on the data lines $\mathbf{11}_1$ and $\mathbf{11}_2$, respectively. When the switch control signal DOT_SW is deactivated, on the other hand, the output terminals $\mathbf{3}_1$ is connected with the associated negative drive circuit 24*d*, and the output terminals $\mathbf{3}_2$ is electrically connected with the associated positive drive circuit 23*d*. Such connections achieve providing negative and positive data signals on the data lines $\mathbf{11}_1$ and $\mathbf{11}_2$, respectively.

The precharge switch circuits 23*e* are each composed of a switch 23*f* connected between a grounded terminal 23*g* and the output of the associated positive drive circuit 23*d*. The switches 23*f* are turned on in response to the activation of the precharge signal GND_SW received from the precharge switch timing generator 27. Correspondingly, the precharge switch circuits 24*e* are each composed of a switch 24*f* connected between a grounded terminal 24*g* and the output of the associated negative drive circuit 24*d*. The switches 24*f* are turned on in response to the activation of the precharge signal GND_SW received from the precharge switch timing generator 27. The turn-on of the switches 23*f* and 24*f* results in precharging all of the data lines 11 to the ground level of the LCD driver 2.

(Operation of LCD Apparatus)

One feature of the LCD apparatus 10 in this embodiment is that the positive-side driver circuitries 23 develop data signals having the positive polarity with respect to the ground level of the LCD driver 2, and the negative-side driver circuitries 24 develop data signals having the negative polarity with respect to the ground level of the LCD driver 2. Such architecture effectively reduces the power consumption of the LCD driver 2, because none of the positive and negative drive circuits 23*d* and 24*d* requires high power supply voltages (typically, twice as high as the maximum voltage across the pixels) to develop data signals.

Figure 6:
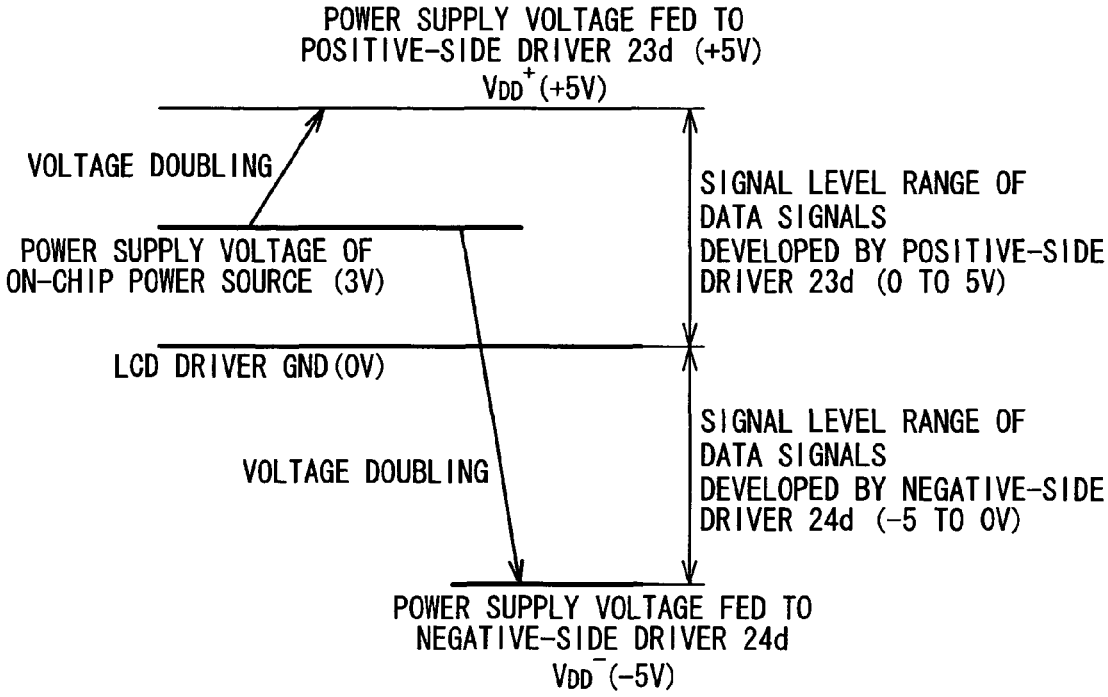
FIG. 6 is a diagram illustrating relations of power supply voltages fed to positive and negative drive circuits to signal levels of the data signals generated by the positive and negative drive circuits with respect to the LCD driver in this embodiment.

Referring FIG. 6, for example, let us consider the case that the power supply voltage of the general power source of the LCD driver 2 is 3 V, the common potential is 0 V, and the maximum voltage across the pixels is 5 V. In this case, the signal levels of the data signals developed by the positive drive circuits 23d are in the range of 0 to 5 V, and therefore the positive drive circuits 23*d* require to be fed with a power supply voltage $V_{DD}^+$ of 5 V. On the other hand, the negative drive circuits 24*d* require to be fed with a power supply voltage $V_{DD}^-$ of −5 V, because the signal levels of the data signals developed by the negative drive circuits 24*d* are in the range of −5 to 0 V. As thus described, the LCD apparatus 10 in this embodiment reduces the absolute values of the power supply voltages down to the maximum voltages applied across the pixels 13; it should be noted that the drive circuits 103 within the positive-side driver circuitries 103 requires to be fed with a power supply voltage twice as high as the maximum voltages applied across the pixels 13. Eliminating the need for providing the high power supply voltage is effective for reducing the power consumption of the LCD driver 2, since the power consumption of the positive and negative drive circuits 23*d* and 24*d* proportionally increases as the increase in the power supply voltage fed thereto.

In the above-described operation, the common potential $V_{COM}$ may be sustained at the ground level of the LCD driver 2 or a level close to the ground level. It should be noted that the common potential $V_{COM}$ is not limited to be identical to the ground level of the LCD driver 2 under the conditions that the signal levels of the positive data signals are higher than the common potential $V_{COM}$, and the signal levels of the negative data signals are lower than the common potential $V_{COM}$. In one embodiment, for example, the common potential $V_{COM}$ may be −0.5 V when the signal levels of the positive data signals are in the range of 1.0 to 5.0 V, and the signal levels of the negative data signals are in the range of −5.0 to −1.0 V. In some situations, the fact that the common potential $V_{COM}$ is different from the ground level of the LCD driver 2 is preferable for displaying desired grayscale levels on the pixels 13. More specifically, setting the common potential $V_{COM}$ to a negative potential effectively cancels an undesirable influence of the pull-down of the gate lines 12 which changes the voltages applied across the pixels 13 through capacitive coupling between the gate lines 12 and the pixels 13.

Another feature of the LCD apparatus 10 in this embodiment is that the data lines 11 are precharged to the ground level of the LCD driver 2. The precharge of the data lines 11 is achieved by the precharge switch circuits 23*e* and 24*e*. The precharge of the data lines 11 is important for avoiding the circuit elements within the positive and negative drive circuits 23*d* and 24*d* being applied with a high voltage. After the data lines 11 driven to negative levels by the negative drive circuits 24*d* are connected with the positive drive circuits 23*d*, for example, the circuit elements within the positive drive circuits 23*d* may be applied with a voltage twice as high as the maximum voltage applied across the pixels 13; however precharging the data lines 11 to the ground level effectively avoids the circuit elements within the positive drive circuits 23*d* being applied with such a high voltage. The same applies to the negative drive circuits 24*d*.

It is of importance for reducing the power consumption necessary for precharging that the level to which the data lines 11 are precharged is the ground level of the LCD driver 2; it should be noted that the level to which the data lines 11 are precharged is determined to be the ground level of the LCD driver 2 even if the common potential $V_{COM}$ is not equal to the ground level of the LCD driver 2.

Figure 1:
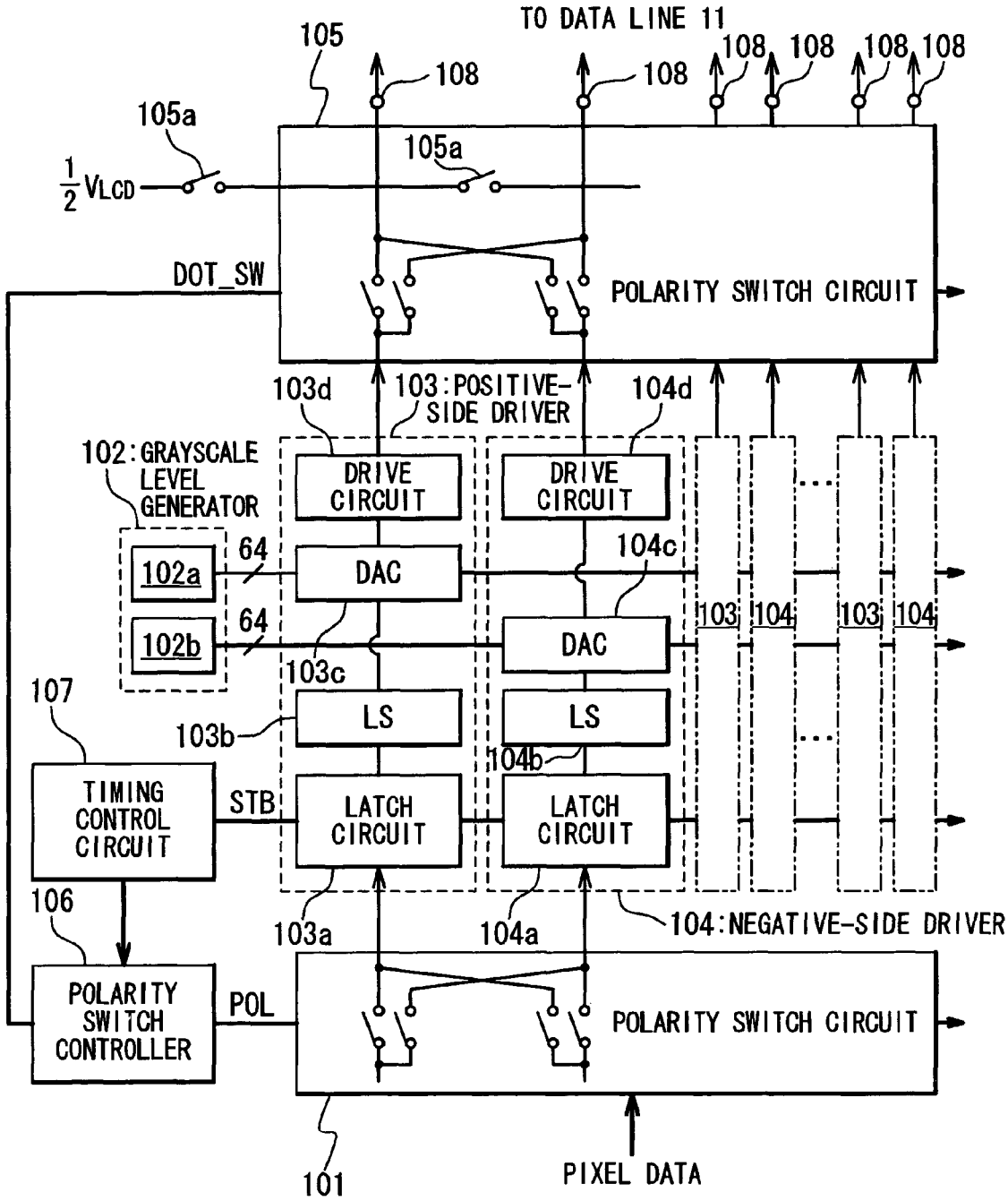
Fig. 1 PRIOR ART
FIG. 1 is a block diagram illustrating a conventional LCD driver.
Figure 2:
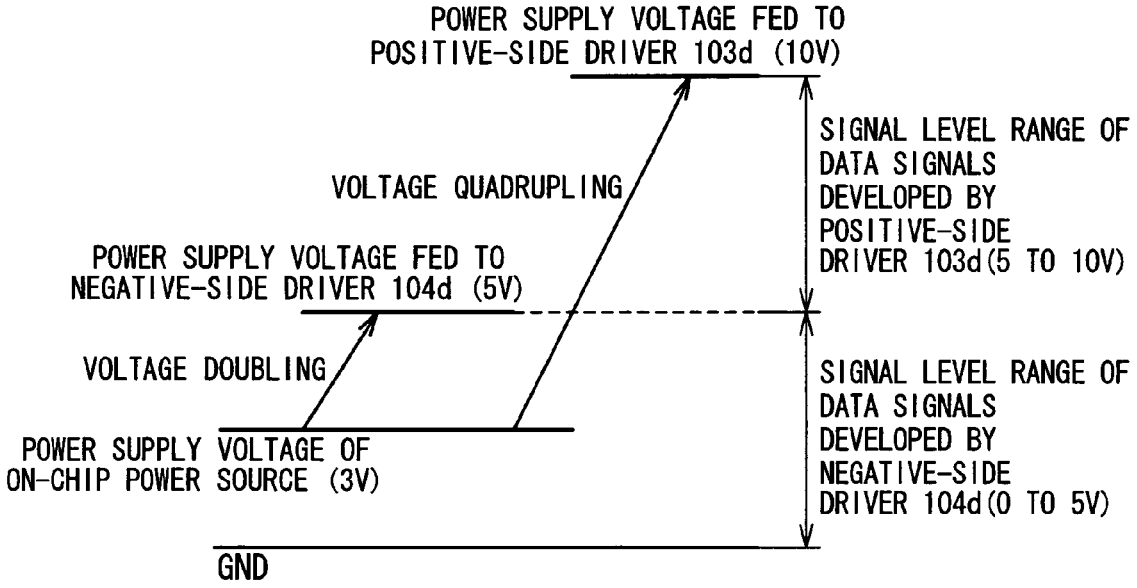
Fig. 2 PRIOR ART
FIG. 2 is a diagram illustrating relations of power supply voltages fed to positive and negative drive circuits to signal levels of the data signals generated by the positive and negative drive circuits with respect to a conventional LCD driver.

An LCD driver architecture which achieves precharging through connecting the data lines with a power line having a certain level different from the ground level, such as the LCD driver architecture shown in FIG. 1, requires avoiding the potential of the power line being changed by the current flow into or from the power line. Therefore, some power is consumed to maintain the level of the power line.

On the contrary, the architecture of the LCD apparatus 10 in this embodiment, which precharges the data lines 11 within the LCD panel 1 to the ground level of the LCD driver 2, do not require power for maintaining the potential of a power line used for the precharge of the data lines 11. As a result, the LCD apparatus 10 in this embodiment effectively reduces the power consumption.

(Operation Example)

Figure 7:
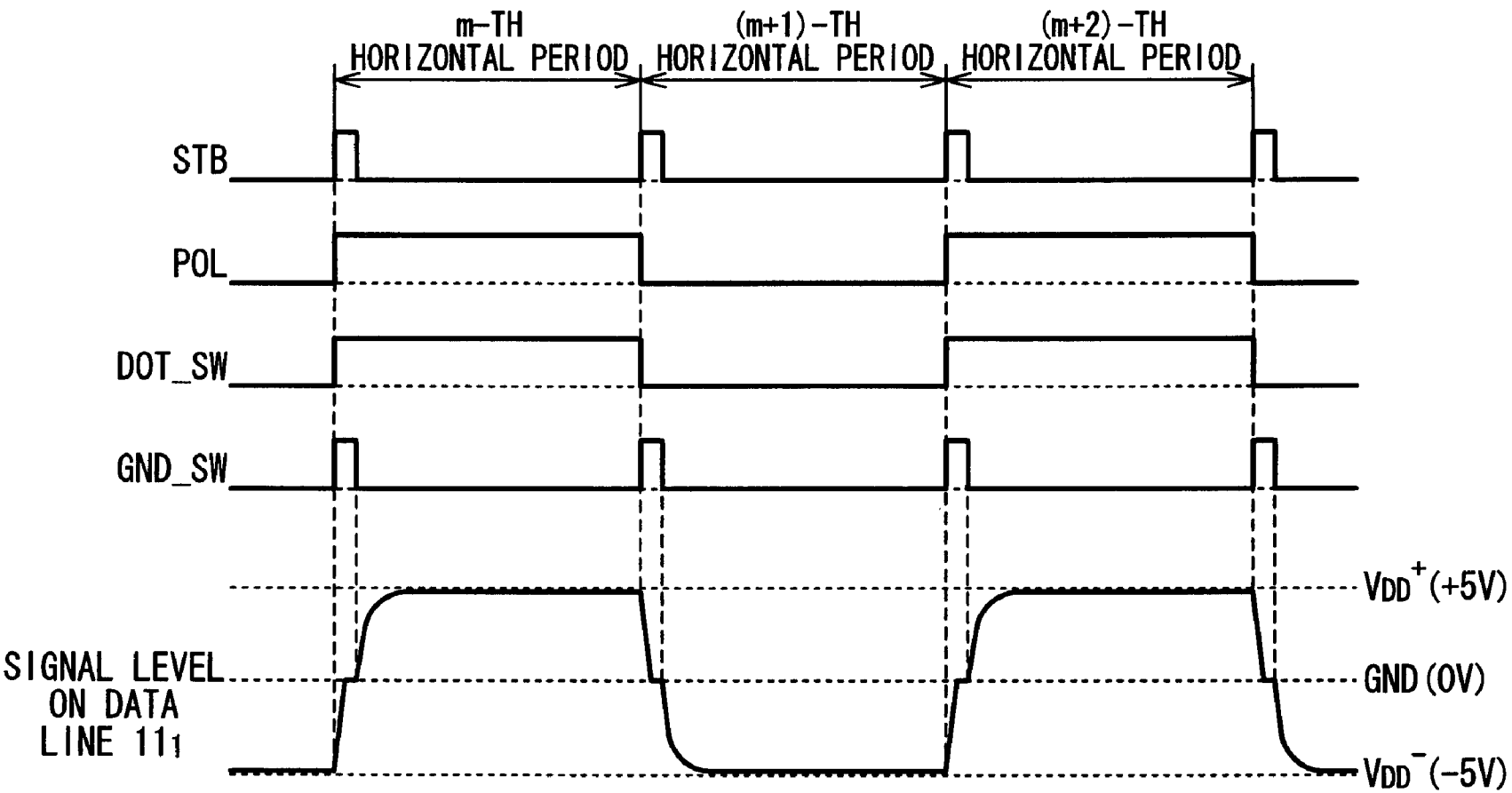
FIG. 7 is a timing chart illustrating an exemplary operation of the LCD driver in the first embodiment.

FIG. 7 is a timing chart illustrating an exemplary operation of the LCD apparatus 10 in this embodiment. In this embodiment, the LCD apparatus 10 adopts a dot inversion driving technique, which designates a drive method in which the polarities of data signals applied to two pixels adjacent in any of horizontal and vertical directions are complement. It should be noted that the dot inversion driving technique involves inversing the polarities of the data signals applied to the respective data lines 11 every horizontal period.

At the beginning of an m-th horizontal period, the pixel data associated with the pixels on the selected line are inputted to the input-side polarity switch circuitry 21. Additionally, the polarity signal POL and the switch control signal DOT_SW are switched to switch connections within the polarity switch circuitries 21 and 25 in accordance with the polarities of the data signals to be fed to the respective data lines 11. Furthermore, the latch signal STB is activated to allow the latch circuits 23*a* and 24*a* within the positive-side and negative-side driver circuitries to latch the associated pixel data.

Furthermore, the precharge signal GND_SW is activated at the beginning of the m-th horizontal period. In response to the activation of the precharge signal GND_SW, the switches 23*f* and 24*f* within the precharge switch circuits 23*e* and 24*e* are turned on to precharge all the data liens 11 to the ground level of the LCD driver 2. As mentioned above, precharging the data lines 11 to the ground level of the LCD driver 2 is important for avoiding the circuit elements within the positive and negative drive circuits 23*d* and 24*d* being applied with a high voltage.

After the precharge is completed, the positive and negative drive circuits 23*d* and 24*d* are activated. Upon being activated, the positive and negative drive circuits 23*d* and 24*d* drive the associated data lines 11 to the signal levels corresponding to the pixel data. Additionally, the gate line 12 associated with the selected line is activated to drive the pixels 13 on the selected line. In the operation shown in FIG. 7, the data line 11l is driven to a positive level with respect to the ground level of the LCD driver 2, during the m-th horizontal period.

During an (m+1)-th horizontal period following the m-th horizontal period, the data lines 11 are driven so that the polarities of the data signals applied to the respective data lines 11 during the (m+1)-th horizontal period are opposite to those of the data signals applied to the respective data lines 11 during the m-th horizontal period. Specifically, the polarity signal POL and the switch control signal DOT_SW are inverted at the beginning of the (m+1)-th horizontal period. The data lines 11 are precharged to the ground level of the LCD driver 2 before the inversion of the polarities of the data signals provided for the data lines 11, and this prevents the circuit elements within the positive and negative drive circuits 23*d* and 24*d* from being applied with a high voltage.

Although FIG. 7 illustrates the operation in which the precharge signal GND_SW is activated to precharge the data lines 11 at the beginning of each horizontal period, it should be noted that the data lines 11 may be not precharged when the polarities of the data lines supplied to the data lines 11 are not inverted. Rather, an operation in which the data lines 11 are not precharged when the polarities of the data lines supplied to the data lines 11 are not inverted is effective for reducing the power consumption.

Figure 8:
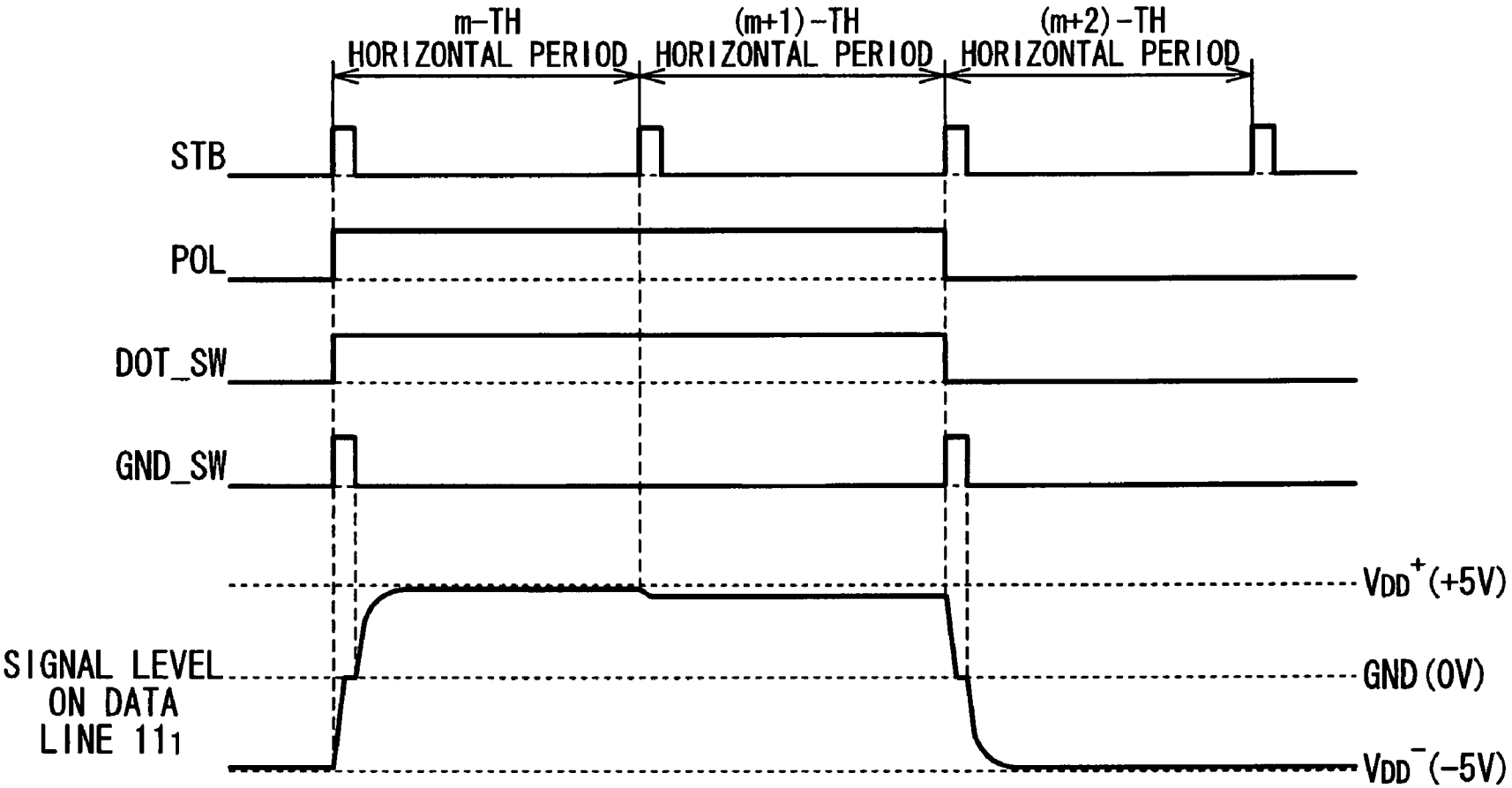
FIG. 8 is a timing chart illustrating another exemplary operation of the LCD drier in the first embodiment.

As shown in FIG. 8, for example, a 2H inversion driving technique, in which the polarities of the data signals are inverted every two pixels in the vertical direction, inverts the polarities of the data signals supplied to the data lines 11 every two horizontal periods. Therefore, the 2H inversion driving technique does not require precharging the data lines 11 at the beginning of every horizontal period. The operation shown in FIG. 8, for example the data line 111 is applied with a data signal of the positive polarity during both of the m-th and (m+1)-th horizontal periods. In this case, the data lines are not precharged at the beginning of the (m+1)-th horizontal period. During the (m+2)-th horizontal period following the (m+1)-th horizontal period, the polarities of the data signals applied to the data lines 11 are inverted. Therefore, the data lines 11 are precharged at the beginning of the (m+2)-th horizontal period to avoid the circuit elements within the positive and negative drive circuits 23*d* and 24*d* being applied with a high voltage.

Figure 9:
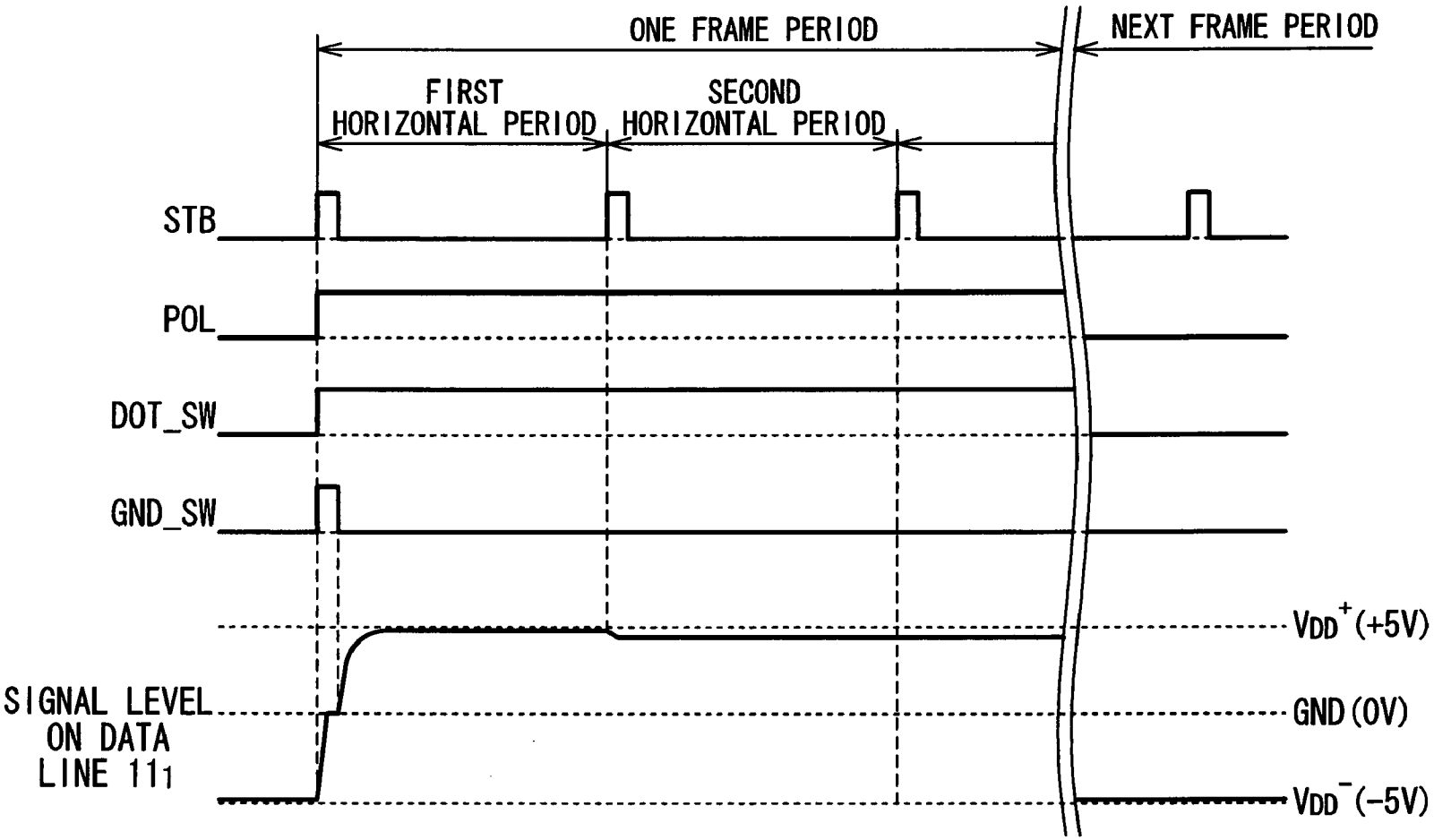
FIG. 9 is a timing chart illustrating still another exemplary operation of the LCD driver in the first embodiment.

As shown in FIG. 9, the same applies to a V-direction inverse driving, in which each data line 11 is continuously driven with a data signal of the same polarity during each frame period. In the V-direction inverse driving, the polarity of the data signal applied to each data line 11 is not inverted at the middle of each frame period. Therefore, the data lines 11 are precharged at the beginning of the first horizontal period of a certain frame period; the data lines 11 are not precharged during the following horizontal periods of the frame period. The data lines 11 are precharged again at the beginning of the first horizontal period of the next frame period.

Second Embodiment (LCD Apparatus Structure)

Figure 10:
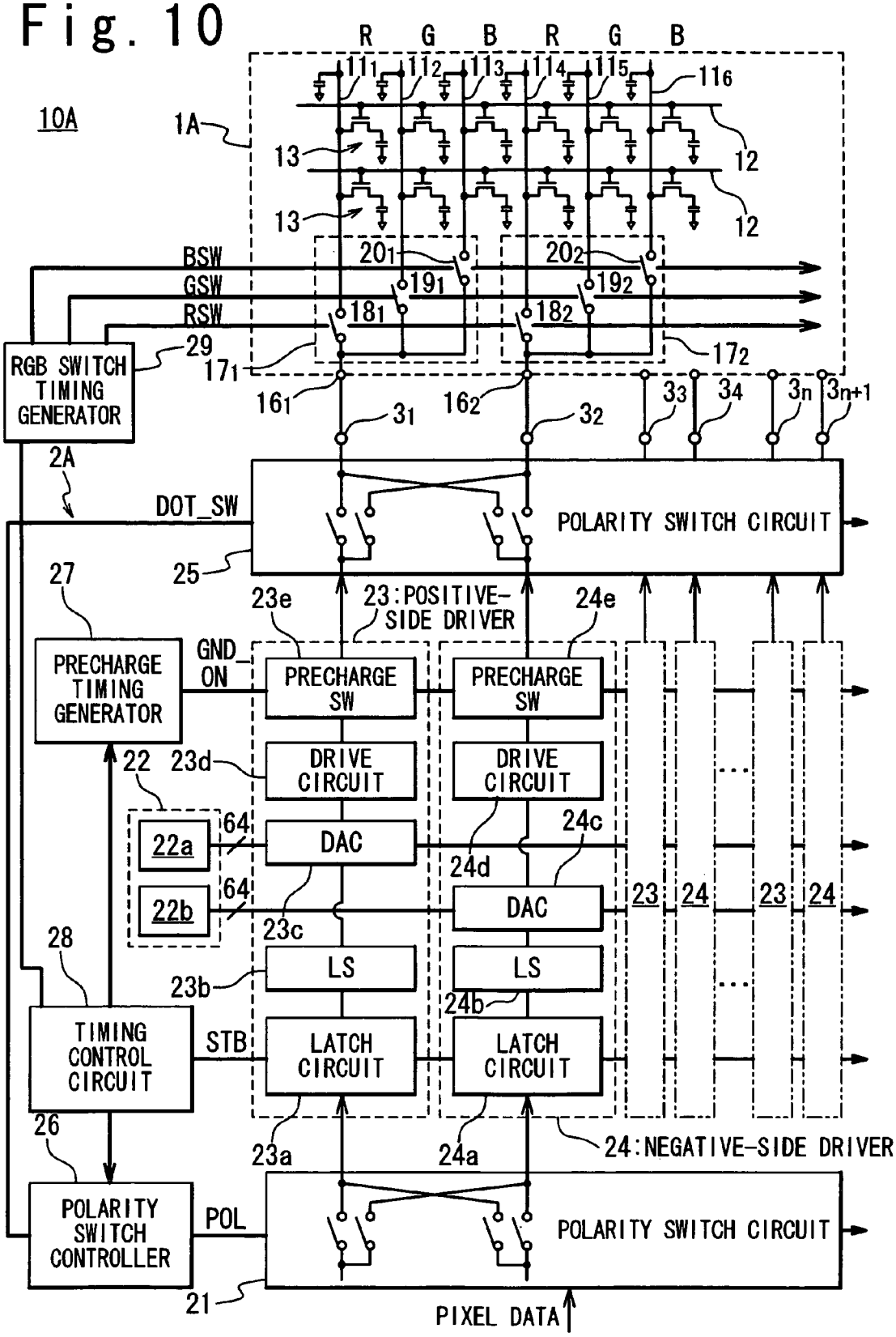
FIG. 10 is a block diagram illustrating an exemplary structure of an LCD apparatus in a second embodiment of the present invention.

FIG. 10 is a block diagram illustrating an exemplary structure of an LCD apparatus 10A in a second embodiment of the present invention. The structure of the LCD apparatus 10A in the second embodiment is similar to that of the LCD apparatus 10 in the first embodiment; the positive-side driver circuitries 23 are designed to develop data signals of the positive polarity with respect to the ground level of the LCD driver 2, and the negative-side driver circuitries 24 are designed to develop data signals of the negative polarity with respect to the ground level of the LCD driver 2. As mentioned above, such architecture effectively reduces the power consumption of the LCD driver 2.

The difference is that the LCD driver 10A in the second embodiment adopts a time-divisional driving technique, which involves time-divisionally driving pixels in the same line through sequentially selecting data lines. The time-divisional driving technique is widely used in LCD apparatuses, because this technique effectively reduces the number of drive circuits developing data signals, and also reduces the number of signal line connected between the LCD driver and the LCD panel.

In accordance with the use of the time-divisional driving technique, the structures of the LCD panel and the LCD driver is modified from those of the first embodiment; the LCD panel and the LCD driver in this embodiment are denoted by numerals 1A, and 2A, respectively.

In this embodiment, the pixels 13 connected with the same data line 11 are associated with the same color. Specifically, the pixels 13 connected with the data lines $\mathbf{11}_1$, $\mathbf{11}_4$ . . . are associated with red (R). And, the pixels 13 connected with the data lines $\mathbf{11}_2$, $\mathbf{11}_5$ . . . are associated with green (G), and the pixels 13 connected with the data lines $\mathbf{11}_3$, $\mathbf{11}_6$ . . . are associated with blue (B). The pixels 13 associated with red are used for displaying the red color. Correspondingly, the pixels 13 associated with green are used for displaying the green color, and the pixels 13 associated with blue are used for displaying the blue color. In order to explicitly describe the association of the pixels 13 with the colors, the pixels 13 associated with red, green and blue are referred to as the R pixels 13, the G pixels 13, and the B pixels 13, respectively.

Additionally, the LCD panel 1A is provided with one input terminal for a plurality of data lines 11. In this embodiment, one input terminal 16 is associated with three data lines 11. For example, the input terminal $\mathbf{16}_1$ is associated with the data lines $\mathbf{11}_1$ to $\mathbf{11}_3$, and the input terminal $\mathbf{16}_2$ is associated with the data lines $\mathbf{11}_4$ to $\mathbf{11}_6$.

Figure 11:
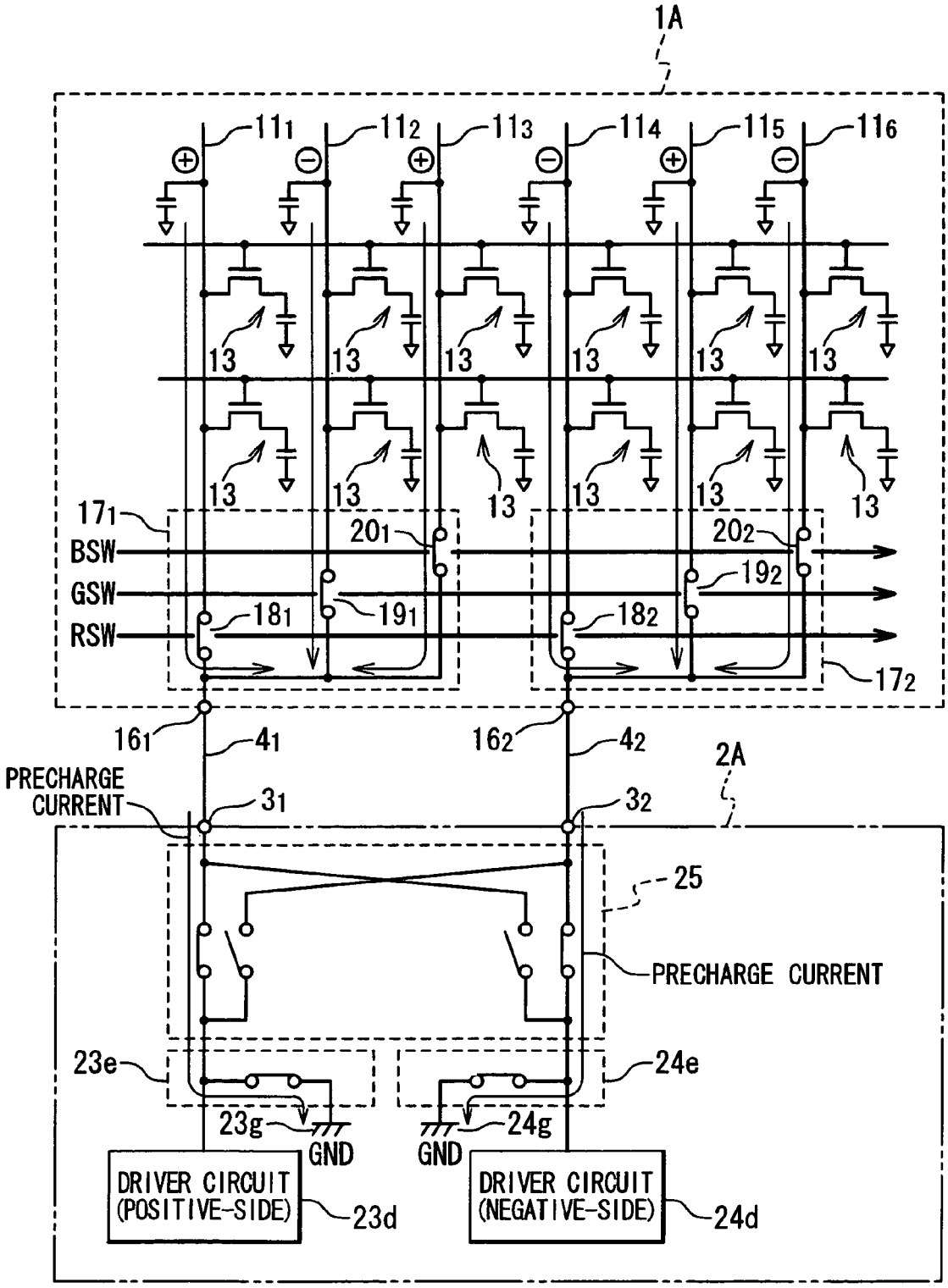
FIGS. 11 and 12 are conceptual diagrams illustrating an exemplary operation of the LCD driver in precharging the data lines.

Furthermore, selectors 17 are disposed between the data lines 11 and the input terminals 16 to select the data lines 11 to be connected with the input terminals 16. For example, the selector $\mathbf{17}_1$ selectively connects desired one of the data lines $\mathbf{11}_1$ to $\mathbf{11}_3$ with the input terminal $\mathbf{16}_1$, and the selector $\mathbf{17}_2$ selectively connects desired one of the data lines $\mathbf{11}_4$ to $\mathbf{11}_6$ with the input terminal $\mathbf{16}_2$. The selectors 17 are responsive to a set of control signals RSW, GSW, and BSW received from the LCD driver 2 for connecting desired ones of the data lines 11 with the input terminals 16. As shown in FIG. 11, each selector 17 is composed of three switches: an R switch 18, a G switch 19, and a B switch 20. The R switches 18 are connected between the data lines 11 connected with the R pixels 13 and the associated input terminals 16, and turned on in response to the activation of the control signal RSW. Correspondingly, the G switches 19 are connected between the data lines 11 connected with the G pixels 13 and the associated input terminals 16, and turned on in response to the activation of the control signal GSW. Finally, the B switches 20 are connected between the data lines 11 connected with the B pixels 13 and the associated input terminals 16, and turned on in response to the activation of the control signal BSW.

Referring back to FIG. 10, the LCD driver 2A in this embodiment is different from the LCD driver 2 in the first embodiment as follows: Firstly, the structures of the positive-side and negative-side driver circuitries 23 and 24 are modified so that each of them can provides data signals for a plurality of data lines 11. Specifically, the structure of the latch circuits 23*a* and 24*a* within the positive-side and negative-side driver circuitries 23 and 24 are modified to store the pixels data of the pixels associated with a plurality of data lines 11. Furthermore, the positive-side and negative-side driver circuitries 23 and 24 additionally includes RGB selectors 23*h*, and 24*h*, respectively for selecting the pixel data stored in the latch circuits 23*a* and 24*a*. The RGB selectors 23*h*, and 24*h* provides the D/A converters 23*c* and 24*c* with the pixel data associated with the data lines 11 selected by the selectors 17 through the level shifters 23*b* and 24*b*.

Secondly, the LCD driver 2A additionally includes an RGB switch timing generator 29 and an RGB selector control circuit 30. The RGB switch timing generator 29 generates the control signals RSW, GSW and BSW used for selecting the data liens 11 so that desired ones of the data lines 11 are connected with the associated input terminals 16. The RGB selector control circuit 30 controls the RGB selectors 23*h* and 24*h*. The RGB selector control circuit 30 provides control signals for the RGB selectors 23*h*, and 24*h*, and thereby allows the RGB selectors 23*h*, and 24*h* to select the pixel data associated with the selected data lines 11. The data signals are developed in response to the pixel data selected by the RGB selectors 23*h*, and 24*h*.

(Operation of LCD Apparatus)

In this embodiment, both of the dime-divisional driving and the dot inverse driving are used for driving the LCD panel 1A. Specifically, the pixels 13 of the selected line are time-divisionally driven with the associated data signals through sequentially selecting three data liens 11 associated with the same input terminal 16. The polarities of the data signals are determined so that two pixels adjacent to any of the vertical and horizontal directions are driven with the data signals of opposite polarities. It should be noted that the polarities of the signal levels on the adjacent data lines 11 are opposite to each other.

In connection with the serial selection of the data lines 11, the data lines 11 are precharge in a manner different from that in the first embodiment. Firstly, as shown in FIG. 11, the data lines 11 are precharged while the R switches 18, the G switches 19, and the B switches 20 are turned on; in other words, the switches 23*g* and 24*g* within the precharge switch circuits 23*e* and 24*e* are turned on with all the data lines 11 connected with the associated input terminals 16. This allows all the data lines 11 to be precharged to the ground level of the LCD driver 2A at the same time.

Precharging all the data lines 11 at the same time is advantageous for reducing noise from the reason as follows. The use of the dot inverse driving results in that the charges are canceled between two of the three data lines 11 connected with the same input terminal 16. Therefore, each of the precharge switch circuits 23*e* and 24*e* equivalently receives electric charges from only one data line 11. For the case that the data lines $\mathbf{11}_1$ to $\mathbf{11}_3$ are precharged after the data lines $\mathbf{11}_1$ and $\mathbf{11}_3$ are driven to positive levels and the data line $\mathbf{11}_2$ is driven to a negative level, for example, electric charges accumulated on one of the data lines $\mathbf{11}_1$ and $\mathbf{11}_3$ are cancelled by electric charges accumulated on the data line $\mathbf{11}_2$. Therefore, the amount of the electric charges introduced into the grounded terminal 23*g* within the associated precharge switch circuit 23*e* is approximately equal to the amount of the electric charges accumulated on only one of the data lines $\mathbf{11}_1$ to $\mathbf{11}_3$. This suppresses the change in the grounded level of the LCD driver 2A, and thereby effectively reduces noise.

Figure 12:
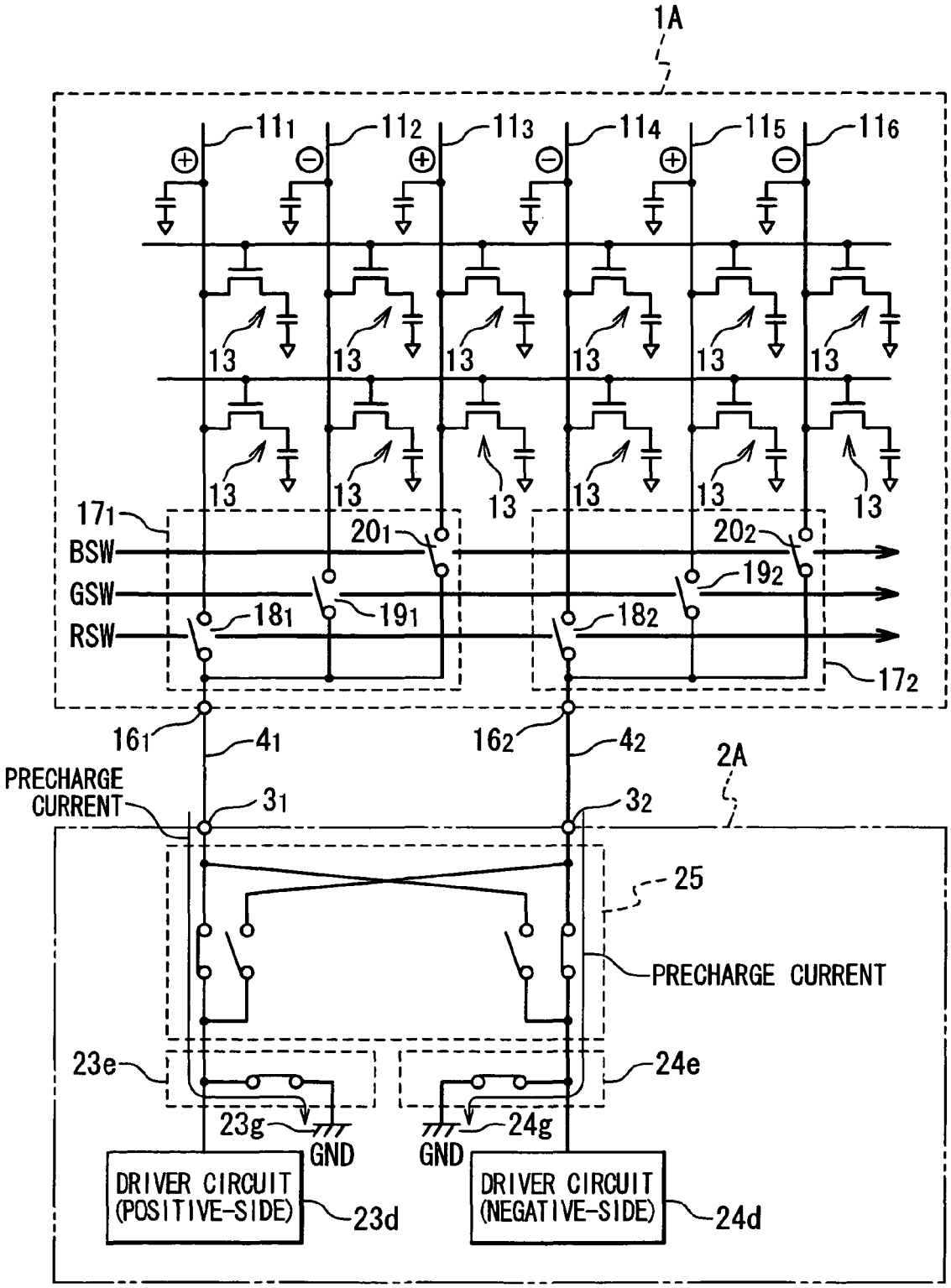

Another difference is that the precharge of the input terminals 16 are additionally performed in addition to the precharge of the data lines 11. This is because the LCD apparatus 10 in this embodiment requires inversing the levels on the input terminals 16 every when the data lines 11 are switched. Let us consider the case that the data line 112 is fed with a negative data signal through the input terminal $\mathbf{16}_1$ after the data line $\mathbf{11}_1$ is fed with a positive data signal. The input terminal $\mathbf{16}_1$ sustains a positive level after the data line $\mathbf{11}_1$ is provided with the positive data signal. Connecting the input terminal $\mathbf{16}_1$ with the associated negative drive circuit 24*d* with a positive level sustained on the input terminal $\mathbf{11}_1$ may lead to applying a high voltage to the circuit elements within the negative drive circuit 24*d*. Therefore, it is desirable to precharge the input terminal $\mathbf{16}_1$ to the ground level of the LCD driver 2 before the input terminal $\mathbf{16}_1$, is connected with the associated negative drive circuit 24*d*. As shown in FIG. 12, the precharge of the input terminals 16 is achieved through turning on the switches 23*g* and 24*g* within the precharge switch circuits 23*e* and 23*e* with the R switches 18, the G switches 19, and the B switches 20 turned off.

It would be desirable for reducing the duration of cycles necessary for serially driving all the data lines 11 that the precharge duration of the input terminals 16 is shorter than that of the data lines 11; is should be noted that the precharge duration of the input terminals 16 designates the duration of period during which the input terminals 16 are electrically connected with the grounded terminals 23*g* and 24*g* within the LCD driver 2A with the data lines 11 electrically disconnected from the input terminals 16, and that the precharge duration of the data lines 11 designates the duration of period during which the data lines 11 are electrically connected with the grounded terminals 23*g* and 24*g*. Although being required to be long enough to completely precharge the input terminals to the ground level, it is not a problem that the precharge duration of the input terminals 16 is shorter than that of the data lines 11. This is because that the total capacitance of the input terminals 16 of the LCD panel 1 and the signal lines 4 connected therewith is extremely smaller than that of the data lines 11. In one embodiment, each data line 11 has a capacitance of several tens of pF, while the total capacitance of one input terminal 16 and the signal line 4 connected therewith is several pF. Rather, reducing the precharge duration of the input terminals 16 below that of the data lines 11 effectively shortens the duration necessary for serially driving all the data lines 11, and thereby effectively reduces the allowable minimum duration of each horizontal period.

(Operation Example)

Figure 13:
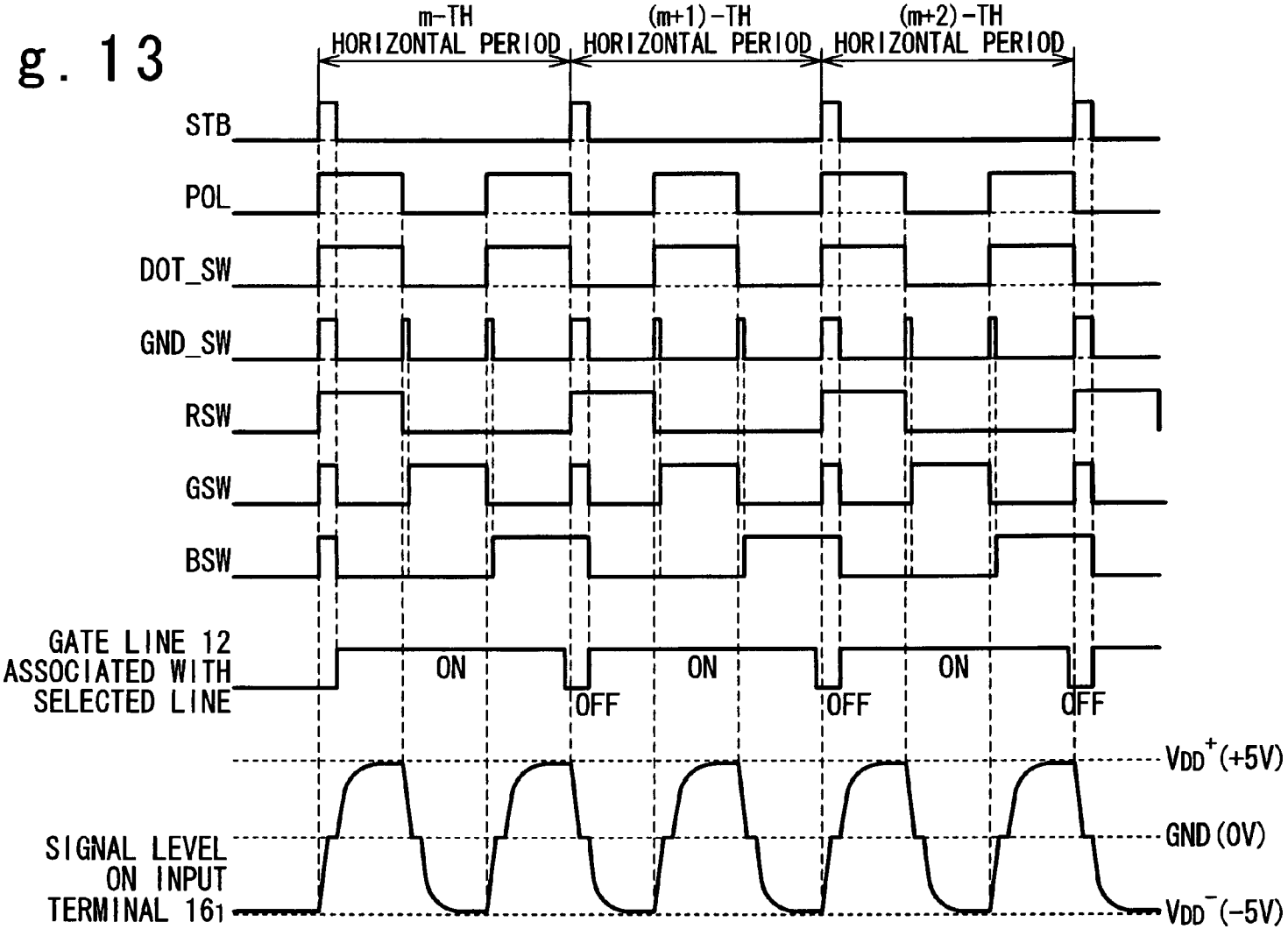
FIG. 13 is a timing chart illustrating an exemplary operation of the LCD driver in the second embodiment.

FIG. 13 is a timing charge illustrating an exemplary operation of the LCD apparatus 10A in this embodiment.

At the beginning of an m-th horizontal period, the pixel data associated with the pixels on the selected line are inputted to the input-side polarity switch circuitry 21, and the polarity signal POL and the switch control signal DOT_SW are switched. This allows the polarity switch circuitries 21 and 25 to switch the connections therein in accordance with the polarities of the data signals supplied to the respective data lines 11 during the m-th horizontal period. Additionally, the latch signal STB is activated to latch the pixel data into the latch circuits 23*a* and 24*a* within the positive-side and negative side driver circuitries 23 and 24.

Furthermore, all of the precharge control signal GND_SW and the control signals RSW, GSW, and BSW are activated at the beginning of the m-th horizontal period to turn on the R switches 18, the G switches 19, and the B switches within all the selectors 17, and to turn on the switches 23*f* and 24*f* within the precharge switch circuit 23*e* and 24*e*. This allows all the data lines 11 to be precharged to the ground level of the LCD driver 2. As mentioned above, precharging the data lines 11 to the ground level of the LCD driver 2 is important for avoiding a high voltage being applied to the circuit elements within the positive and negative drive circuits 23*d* and 24*e*.

After the precharge is completed, the data lines 11 connected with the R pixels 13 are provided with the data signals, and the R pixels 13 on the selected line are driven with the provided data signals. In detail, the RGB selectors 23*h* and 24*h* select the pixel data associated with the R pixels 13, and the positive and negative drive circuits 23*d* and 24*d* generate the data signals corresponding to the selected pixel data; the data signals generated by the positive drive circuits 23*d* have the positive polarity with respect to the ground level of the LCD driver 2, while the data signals generated by the negative drive circuits 24*d* have the negative polarity with respect to the ground level of the LCD driver 2.

Additionally the control signal RSW is selectively activated to electrically connect the data lines 11 associated with the R pixels 13 with the associated input terminals 16, with the control signals GSW and BSW deactivated. This allows the data signals generated by the positive and negative drive circuits 23*d* and 24*d* to be provided for the data lines 11 connected with the R pixels 13. Additionally, the gate line 12 associated with the selected line is activated to drive the R pixels 13 on the selected line by the associated data signals.

This is followed by driving the G pixels 13 on the selected line with the associated data signals. Driving the G pixels 13 on the selected line begins with precharging the input terminals 16. In detail, the precharge signal GND_SW is activated with all the control signals RSW, GSW, and BSW deactivated. This achieves precharging the input terminals 16 to the ground level of the LCD driver 2A through electrically connecting the input terminals 16 with the ground terminal of the LCD driver 2A. As mentioned above, the precharge duration of the input terminals 16 is shorter than that of the data lines 11.

During the precharge of the input terminals 16, the polarity signal POL and the switch control signal DOT_SW are switched. This allows the output-side polarity switch circuitry 25 to switch the connection therein in accordance with the polarities of the data signals to be provided for the data liens 11 connected to the G pixels 13 during the m-th horizontal period.

The data lines 11 connected with the G pixels 13 are then supplied with the associated data signals. In detail, the RGB selectors 23*h* and 24*h* select the pixel data associated with the G pixels, and the positive and negative drive circuits 23*d* and 24*d* generate the data signal associated with the selected pixel data. Furthermore, the control signal GSW is selectively activated to electrically connect the data lines 11 associated with the G pixels 13 with the associated input terminals 16. This allows the data signals generated by the positive and negative drive circuits 23*d* and 24*d* to be supplied to the data lines 11 connected with the G pixels 13. This achieves driving the G pixels 13 on the selected line by the associated data signals.

This is followed by driving the B pixels 13 on the selected line with the associated data signals. The procedure of driving the B pixels 13 is almost identical to that of driving the G pixels 13 except for that the RGB selectors 23*h* and 24*h* select the pixel data associated with the B pixels 13, and that the control signal BSW is activated instead of the control signal GSW.

The same operation is implemented during the following horizontal period.

It is apparent that the present invention is not limited to the above-described embodiments, which may be modified and changed without departing from the scope of the invention.

For example, the switches 23*f* and 24*f* are directly connected with the output terminals 3 of the LCD driver 2 (or 2A) instead of the outputs of the positive and negative drive circuits 23*d* and 24*d*.

Additionally, the selectors 17 shown in FIG. 10 may be integrated within the LCD driver 2A instead of the LCD panel 1. The necessary modification for integrating the selectors 17 within the LCD driver 2A would be apparent to those skilled in the art.

What is claimed is:

1. A liquid crystal display apparatus comprising:

an LCD panel including a plurality of data lines and a common electrode having a common potential, Vcom; and an LCD driver including:

a positive drive circuit including a first amplifier which is fed with a first power supply voltage of positive polarity with respect to a ground level of said LCD driver and provides a positive data signal having positive polarity with respect to said ground level of said LCD driver for one of said data lines; and a negative drive circuit including a second amplifier which is fed with a second power supply voltage of negative polarity with respect to said ground level of said LCD driver and provides a negative data signal having negative polarity with respect to said ground level of said LCD driver for another one of said data lines.

2. The liquid crystal display apparatus according to claim 1, further comprising:

a precharge circuitry for precharging said data lines within said LCD panel to said ground level of said LCD driver.

3. The liquid crystal display apparatus according to claim 2, wherein said positive drive circuit provides a first data line selected out of said data lines with said positive data signal in a first horizontal period and a second horizontal period following said first horizontal period, wherein said negative drive circuit provides a second data line selected out of said data lines with said negative data signal in said first and second horizontal period;

wherein said precharge circuitry precharges said data lines of said LCD panel to said grounded level in said first horizontal period before said first and second data lines are provided with said positive and negative data signals, respectively, and wherein said precharge circuitry does not precharge said data lines of said LCD panel during said second horizontal period.

4. The liquid crystal display apparatus according to claim 1, wherein said LCD driver further comprises:

a first precharge switch coupled to a grounded terminal and an output of said positive drive circuit; and a second precharge switch coupled to a grounded terminal and an output of said negative drive circuit.

5. The liquid crystal display apparatus according to claim 4, further comprising:

a precharge switch timing generator which generates a precharge signal for activating said first and second precharge switches.

6. The liquid crystal display apparatus according to claim 5, wherein said first and second precharge switches are turned on in response to an activation of the precharge signal, resulting in a precharging of said one of said data lines and said another one of said data lines, respectively.

7. The liquid crystal display apparatus according to claim 6, further comprising:

an output-side polarity switch circuitry comprising:

a first switch connected between said positive drive circuit and said one of said data lines;

a second switch connected between said positive drive circuit and said another one of said data lines:

a third switch connected between said negative drive circuit and said one of said data lines; and a fourth switch connected between said negative drive circuit and said another one of said data lines.

8. The liquid crystal display apparatus according to claim 7, further comprising:

a timing control circuit which controls an operation timing of said precharge switch timing generator and said output-side polarity switch circuitry.

9. The liquid crystal display apparatus according to claim 1, wherein the common potential, Vcom, has a value which is the same as the ground level of the LCD driver or a value which is close to the ground level.

10. The liquid crystal display apparatus according to claim 1, wherein the common potential, Vcom, has a value which is different than a value of the ground level of the LCD driver.

11. A liquid crystal display apparatus comprising:

a plurality of input terminals;

a plurality of data lines connected with pixels;

a plurality of selectors;

a common electrode having a common potential, Vcom; and an LCD driver, wherein said plurality of input terminals include first and second input terminals, wherein said plurality of data lines include:

a plurality of first data lines associated with said first input terminal; and a plurality of second data lines associated with said second input terminal;

wherein said plurality of selectors include:

a first selector for connecting selected one of said plurality of first data lines with said first input terminal; and a second selector for connecting selected one of said plurality of second data lines with said second input terminal, wherein said LCD driver includes:

a positive drive circuit including a first amplifier which is fed with a first power supply voltage of positive polarity with respect to a ground level of said LCD driver and provides a positive data signal having positive polarity with respect to a ground level of said LCD driver;

a negative drive circuit including a second amplifier which is fed with a second power supply voltage of negative polarity with respect to said ground level of said LCD driver and provides a negative data signal having negative polarity with respect to said ground level of said LCD driver, a precharge circuitry for precharging said plurality of input terminals to said ground level of said LCD driver; and a control circuit generating a control signal for controlling said plurality of selectors;

wherein, during a first period of a horizontal period, said first selector connects all of said plurality of first data lines with said first input terminal, and said second selector connects all of said plurality of second data lines with said second input terminal, and said precharge circuitry precharges said first and second input terminals to said ground level of said LCD driver; and wherein, during a second period of said horizontal period initiating after said first period, said first selector connects selected one of said plurality of first data lines with said first input terminal, and said second selector connects selected one of said plurality of second data lines with said second input terminal, and said positive drive circuit outputs said positive data signal to one of said first and second input terminals, and said negative drive circuit outputs said negative data signal to another of said first and second input terminals.

12. The liquid crystal display apparatus according to claim 11, wherein, during a third period of said horizontal period initiating after said second period, said first selector electrically disconnects all of said plurality of first data lines from said first input terminal, and said second selector electrically disconnects all of said plurality of second data lines from said second input terminal, and said precharge circuitry precharges said first and second input terminals to said ground level of said LCD driver, and wherein, during a fourth period of said horizontal period initiating after said third period, said first selector connects another selected one of said plurality of first data lines with said first input terminal, and said second selector connects another selected one of said plurality of second data lines with said second input terminal, and said positive drive circuit outputs said positive data signal to said one of said first and second input terminals, and said negative drive circuit outputs said negative data signal to said another of said first and second input terminals.

13. The liquid crystal display apparatus according to claim 12, wherein a duration of period during which said precharge circuitry precharges said first and second input terminals during said third period is shorter than that of period during which said precharge circuitry precharges said first and second input terminals during said first period.

14. An LCD driver used for driving an LCD panel including a plurality of data lines and a common electrode having a common potential, Vcom, comprising:

a positive drive circuit including a first amplifier which is fed with a first power supply voltage of positive polarity with respect to a ground level of said LCD driver and outputs a positive data signal having positive polarity with respect to a ground level of said LCD driver to one of the data lines within the LCD panel; and a negative drive circuit including a second amplifier which is fed with a second power supply voltage of negative polarity with respect to said ground level of said LCD driver and outputs a negative data signal having negative polarity with respect to said ground level of said LCD driver to another one of said data lines within the LCD panel.

15. The LCD driver according to claim 14, further comprising:

a precharge circuitry for precharging said data lines within said LCD panel to said ground level of said LCD driver.

16. The liquid crystal display apparatus according to claim 15, wherein said positive drive circuit provides a first data line selected out of said data lines with said positive data signal in a first horizontal period and a second horizontal period following said first horizontal period, wherein said negative drive circuit provides a second data line selected out of said data lines with said negative data signal in said first and second horizontal period;

wherein said precharge circuitry precharges said data lines of said LCD panel to said grounded level in said first horizontal period before said first and second data lines are provided with said positive and negative data signals, respectively, and wherein said precharge circuitry does not precharge said data lines of said LCD panel during said second horizontal period.

17. A method of driving an LCD panel including a plurality of data lines and a common electrode having a common potential, Vcom using an LCD driver, comprising:

outputting from a first amplifier which is fed with a first power supply voltage of positive polarity with respect to a ground level of said. LCD driver, a positive data signal having positive polarity with respect to the ground level of said LCD driver to one of data lines within said LCD panel; and outputting from a second amplifier which is fed with a second power supply voltage of negative polarity with respect to said ground level of said LCD driver, a negative data signal having negative polarity with respect to said ground level of said LCD driver to another of said data lines within said LCD panel.

18. The method according to claim 17, further comprising:

precharging said data lines to said ground level of said LCD driver.

19. A liquid crystal display (LCD) driver for a liquid crystal display apparatus, the liquid crystal display apparatus comprising:

a plurality of input terminals;

a plurality of data lines connected with pixels;

a common electrode having a common potential, Vcom; and a plurality of selectors, wherein said plurality of input terminals include first and second input terminals, wherein said plurality of data lines include:

a plurality of first data lines associated with said first input terminal; and a plurality of second data lines associated with said second input terminal;

wherein said plurality of selectors include:

a first selector for connecting selected one of said plurality of first data lines with said first input terminal; and a second selector for connecting selected one of said plurality of second data lines with said second input terminal, wherein said LCD driver includes:

a positive drive circuit including a first amplifier which is fed with a first power supply voltage of positive polarity with respect to a ground level of said LCD driver and provides a positive data signal having a positive polarity with respect to a ground level of said LCD driver;

a negative drive circuit including a second amplifier which is fed with a second power supply voltage of negative polarity with respect to said ground level of said LCD driver and provides a negative data signal having a negative polarity with respect to said ground level of said LCD driver;

a precharge circuitry for precharging said plurality of input terminals to said ground level of said LCD driver; and a control circuit generating a control signal for controlling said plurality of selectors, and wherein, during a first period of a horizontal period, said first selector connects all of said plurality of first data lines with said first input terminal, and said second selector connects all of said plurality of second data lines with said second input terminal, and said precharge circuitry precharges said first and second input terminals to said ground level of said LCD driver.

20. The LCD driver according to claim 19, wherein, during a second period of said horizontal period initiating after said first period, said first selector connects a selected one of said plurality of first data lines with said first input terminal, and said second selector connects selected one of said plurality of second data lines with said second input terminal, and said positive drive circuit outputs said positive data signal to one of said first and second input terminals, and said negative drive circuit outputs said negative data signal to another of said first and second input terminals.

21. The LCD driver according to claim 20, wherein, during a third period of said horizontal period initiating after said second period, said first selector electrically disconnects all of said plurality of first data lines from said first input terminal, and said second selector electrically disconnects all of said plurality of second data lines from said second input terminal, and said precharge circuitry precharges said first and second input terminals to said ground level of said LCD driver.

22. The LCD driver according to claim 21, wherein, during a fourth period of said horizontal period initiating after said third period, said first selector connects another selected one of said plurality of first data lines with said first input terminal, and said second selector connects another selected one of said plurality of second data lines with said second input terminal, and said positive drive circuit outputs said positive data signal to said one of said first and second input terminals, and said negative drive circuit outputs said negative data signal to said another of said first and second input terminals.

23. The LCD driver according to claim 22, wherein a duration of period during which said precharge circuitry precharges said first and second input terminals during said third period is shorter than that of period during which said precharge circuitry precharges said first and second input terminals during said first period.

* * * * *